US006326737B1

(12) United States Patent
Billings

(10) Patent No.: US 6,326,737 B1
(45) **Date of Patent: *Dec. 4, 2001**

(54) CURRENT FED PARALLEL RESONANT BALLAST

(76) Inventor: Keith Billings, 9 Westhill Road, Guelph, Ontario (CA), N1H 7R8

( * ) Notice: Subject to any disclaimer, the term of this patent is extended or adjusted under 35 U.S.C. 154(b) by 0 days.

This patent is subject to a terminal disclaimer.

(21) Appl. No.: 09/459,494

(22) Filed: Dec. 13, 1999

Related U.S. Application Data

(63) Continuation of application No. 09/203,070, filed on Dec. 1, 1998, now Pat. No. 6,107,751.

(51) Int. Cl.[7] ..... H05B 37/02

(52) U.S. Cl. ..... 315/224; 315/209 R; 315/287; 315/DIG. 4; 315/DIG. 7; 363/37

(58) Field of Search ..... 315/209 R, 222, 315/224, 226, 244, 239, 94, 194, 287, 291, DIG. 4, DIG. 7; 363/37, 40, 163

(56) References Cited

U.S. PATENT DOCUMENTS 4,277,726 7/1981 Burke ..... 315/98
4,684,850 * 8/1987 Stevens ..... 315/209 R
5,144,205 * 9/1992 Motto et al. ..... 315/244
5,192,896 * 3/1993 Qin ..... 315/224

* cited by examiner

*Primary Examiner*—Haissa Philogene
(74) *Attorney, Agent, or Firm*—Sofer & Haroun, LLP

(57) ABSTRACT

A circuit for supplying AC voltage and current to a gaseous discharge lamp upon the application of DC voltage and current, the circuit comprising: a transformer including a first and a second primary windings; a first capacitance means, coupled across the primary windings to define a resonant circuit; a start-up current source coupled to a drive terminal; first and second transistors coupled to the drive terminal; at least one drive winding coupled on one end to the drive terminal and coupled on the other end to the base of one of the transistors; and first and second current-blocking devices, in one embodiment a diode and in another embodiment a transistor, each current-blocking device configured so as to block a current from flowing into the emitter element of one of the transistors. Additionally, the circuit comprises a means for establishing a constant current flow between the base terminals of the transistors, sufficient to maintain the circuit in an oscillating mode, the means having a linear inductor, a resistor and at least one diode. In another embodiment, the circuit has one drive winding coupled to the base element of the first transistor switching means, and a parallel combination of a second capacitance means and a second resistor means coupled to the base element of the second transistor switching means.

16 Claims, 3 Drawing Sheets

CURRENT FED PARALLEL RESONANT BALLAST

RELATED APPLICATIONS

This application is a continuation application of Applicant's U.S. patent application Ser. No. 09/203,070 now U.S. Pat. No. 6,107,751, which was filed on Dec. 1, 1998, and which is incorporated by reference herein as fully as if set forth in its entirety.

FIELD OF THE INVENTION

The present invention is directed to a ballast for fluorescent lights. More particularly, the invention is directed to a parallel resonant, current-fed ballast circuit which maintains optimum drive conditions for a wide range of input voltages, permitting improved dimming performance.

BACKGROUND OF THE INVENTION

Fluorescent lighting is a very common type of illumination. Fluorescent lamps function when an electrical arc is established between two electrodes located at opposite ends of the lamp. The electrical arc is established by supplying a proper voltage to the lamp. The lamp is filled with an ionizable gas and a very small amount of vaporized mercury. When the arc is established, collisions occur between the electrons and the mercury atoms, causing the emission of ultraviolet energy. The fluorescent lamps have a phosphorous coating on their inner surface, which transforms the ultraviolet energy into diffused, visible light. In order to establish the electrical arc, and thus turn on the lamp, a high voltage is typically required. However, once the lamp has been turned on, a lesser voltage is required to maintain the lamp's operation.

In order to start and operate a fluorescent lamp, a fluorescent lamp ballast is used. Among other functions (such as limiting the current flow through the lamp once it has already been started), a ballast is a device which provides the appropriate voltage to establish the arc through the lamps. Several different kinds of ballasts currently exist, e.g.—series mode and parallel mode. The series mode operates lamps in series across the output voltage of the ballast. The series mode ballast, while capable of performing dimming applications, usually is complex and thus, requires relatively high manufacturing cost. Parallel mode ballasts, while being less complex, and less expensive, are typically unsuitable for dimming applications, as will be explained below.

FIG. 1 shows a schematic diagram of a prior art parallel resonant current-fed circuit, coupled to a DC supply source 190, which functions in a fluorescent lighting ballast. Transformer 101 contains a first primary winding comprising windings 111 and 112 and second primary winding comprising windings 121 and 122. Additionally, the first primary windings of transformer 101 is connected in parallel with capacitors 161, 162 and 163. Primary windings 111 and 112, and capacitors 161, 162 and 163 form a tuned circuit, also known as an L-C parallel resonant circuit, and in conjunction with the other components of the circuit, produce an oscillating action upon the introduction of a start-up current.

Linear inductor 151, is coupled to a center tap terminal 105 of first primary winding of transformer 101 so as to provide a substantially constant current signal to the center tap terminal. Linear inductor 151 is also coupled to a drive terminal 102 of the second primary winding of transformer 101 through a resistor 141, so as to provide the start-up current feed to transistors 131 and 132 respectively. The current feed is sufficient to provide the minimum base drive current required by transistors 131 and 132 to start the transistors to operate in an oscillation mode. After the initial start, transistors 131 and 132 are provided a regenerative feedback current drive generated by windings 121 and 122 as explained later.

In the oscillation mode, transistors 131 and 132 are continuously turned on and off, so as to conduct current alternately through each of primary windings 111 and 112. The alternating current flow through the primary windings creates an AC voltage signal which is applied to a series combination of capacitors 162, 163 and lamps 181 and 182 coupled together in parallel. Capacitors 162 and 163 control the current flow through lamps 181 and 182.

A constant current flow network 154, comprising inductor 152, resistor 142 and diode 171, operates to maintain a substantially constant biasing current flow to the base terminals of transistors 131 and 132 respectively. The base-emitter junction of each transistor acts as a diode, and thus blocks any current flow from returning via windings 121 or 122 to drive terminal 102 through the transistors' base-emitter junction, provided that the voltage applied by the drive windings does not exceed the reverse base-emitter breakdown voltage of the transistors (as will be further discussed later). Diode 171 is configured so as to prevent the reverse flow of current in a direction from drive terminal 102 to constant current flow network 154.

The switching back and forth between transistor 131 and transistor 132 is enhanced by the regenerative feedback current from drive windings 121 and 122, and constant current flow network 154. As shown, windings 121 and 122 are disposed between drive terminal 102 and the base terminals of transistors 131 and 132, respectively. It is desirable to maximize the voltage level across drive windings 121 and 122, since a higher voltage level at the base terminals turns the transistors on and off more rapidly and more efficiently than a low voltage level, and allows a wider range of applied voltage.

As previously mentioned, the voltage at the base terminal of the transistors and across the windings increases and decreases in accordance with the circuit's oscillating nature, and can be represented by a corresponding sine-wave curve. Since transistors 131 and 132 are alternately being turned on and off, the base voltage of each transistor is 180 degrees out of phase with the other. Significantly, there exists a point within each half-cycle of operation of this circuit when the voltage signal of the base terminal of a transistor and the corresponding drive winding voltage passes through zero. This point occurs when one transistor is turning on while the other transistor is turning off At this point, the switching action of the circuit may be interrupted because no current would be flowing to compel the corresponding transistor to turn on or off again. In order to prevent the interruption of the switching action and maintain a constant current flow to the drive windings and transistors, the circuit includes constant current flow network 154 previously described.

The voltages which can be utilized in this circuit are limited by the base-emitter breakdown voltage of the transistors, which is approximately 6.5 to 7 volts. This breakdown voltage limits the voltage level at drive terminal 102 to minus 3.5 volts. This follows because when one of the transistors, e.g.—131, is switched "on" its base-emitter junction acts like a diode to clamp the left-hand side voltage of drive winding 121 to a value near zero or to the common line negative voltage level of power supply 190. At the same time the voltage level at drive terminal 102 and the righthand side of winding 122 and base terminal of transistor 132 is taken to a negative level by an amount that depends on the number of turns of winding 122, and hence the drive voltage of the windings. Thus, because of the limit imposed by the breakdown voltage of the transistors, the total voltage across windings 121 and 122 cannot exceed 7 volts. Hence only 3.5 volts will be generated at the center of the circuit. Exceeding the base-emitter breakdown voltage adversely affects the operation of the transistors and decreases the lifespan of the circuit.

Additionally, since the circuit must maintain a relatively small voltage between the base terminals of the transistors, the resistive value of resistor 142 of constant current flow network 154 is also required to be small. The current-defining resistor 142, in order to permit an appropriate current flow into the center of the circuit, must be in the range of 10 to 20 ohms. Since voltage and current are directly related, a small change in the input supply voltage causes the drive current to change significantly and the lamp to either go out, or to be over driven causing excessive loss. As such, this circuit is unsuitable for dimming applications, since the lamps can not be dimmed over a wide range.

Therefore, there exists a need for a parallel resonant ballast for a fluorescent lamp which permits fluorescent lamps to be efficiently dimmed over a wide range.

SUMMARY OF THE INVENTION

The present invention describes a ballast circuit for supplying AC voltage and current to a gaseous discharge lamp upon the application of DC voltage and current. The circuit comprises: a transformer including a first and a second primary windings; a first capacitance means, coupled across the primary windings to define a resonant circuit; a voltage supply source coupled to a center tap; first and second transistors coupled to the center tap; at least one drive winding coupled on one end to a drive terminal and coupled on the other end to the base of one of the transistors; and a first and second current-blocking means, in one embodiment a diode and in another embodiment a transistor, each current-blocking means configured so as to block a current from flowing into the emitter element of the transistors. Additionally, the circuit comprises a means for establishing a constant current flow to the drive windings, sufficient to maintain the circuit in an oscillating mode, having a linear inductor, a resistor and two diodes, configured so as to deliver current flow to the bases of each transistor.

In another embodiment, the circuit has one drive winding coupled to the base element of the first transistor, and a parallel combination of a second capacitance means and a second resistor means coupled to the base element of the second transistor, so as to provide a pulse current which enhances the switching action of the transistors.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, in which like reference characters denote similar elements throughout the several views.

It is to be understood that the drawings are not necessarily drawn to scale, but that they are merely conceptual in nature.

DETAILED DESCRIPTION OF THE PRESENTLY PREFERRED EMBODIMENTS

The present invention, in accordance with one embodiment, is a parallel resonant, current-fed ballast circuit which utilizes a pair of current-blocking devices, preferably diodes, disposed and configured so as to block reverse current flow into the emitter terminals of the transistors, thus permitting the use of higher drive voltages to facilitate rapid and efficient transistor switching and improved dimming performance, over a wide supply voltage range.

Figure 2:
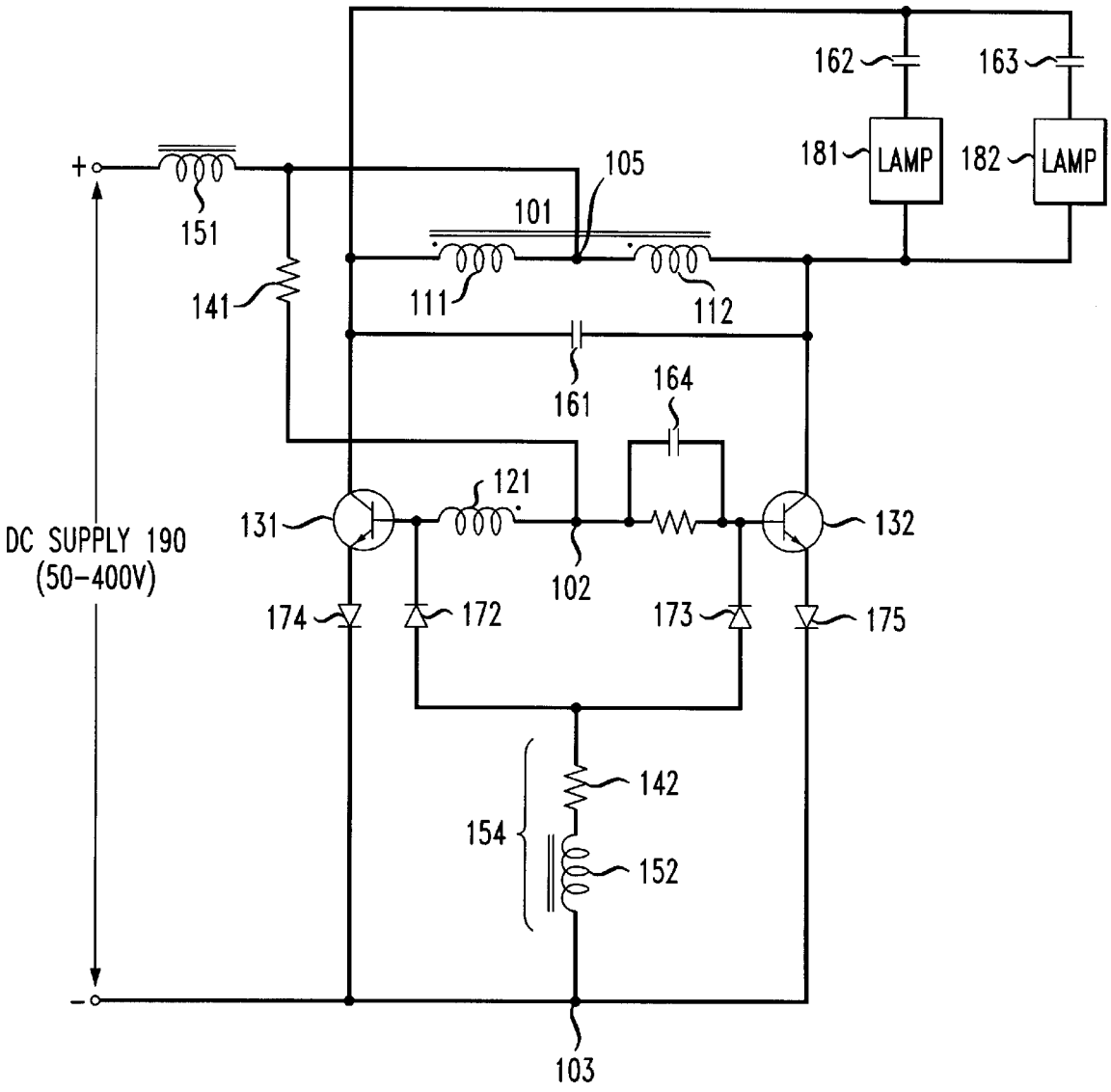
FIG. 2 is a schematic diagram of a parallel resonant, current-fed ballast circuit, in accordance with one embodiment of the present invention.

FIG. 2 illustrates a parallel resonant, current-fed ballast circuit, in accordance with one embodiment of the present invention. The circuit shown in FIG. 2 is suitable to be used in the ballast of a fluorescent lamp. In FIG. 2, transformer 101 contains center-tapped primary winding 111 and 112. Additionally, capacitor 161 is connected across the primary winding 111 and 112. Winding 111 and 112, and capacitors 161, 162 and 163 form a tuned circuit, and in conjunction with the other components of the circuit, generate an oscillating voltage signal, like the one described in the background section, upon the introduction of a start-up current. A DC supply source 190 is coupled to transformer 101 via inductor 151 so as to provide a variable DC current. In accordance with one embodiment of the present invention, the DC voltage level of DC supply source 190 ranges between 150 and 400 volts.

Figure 1:
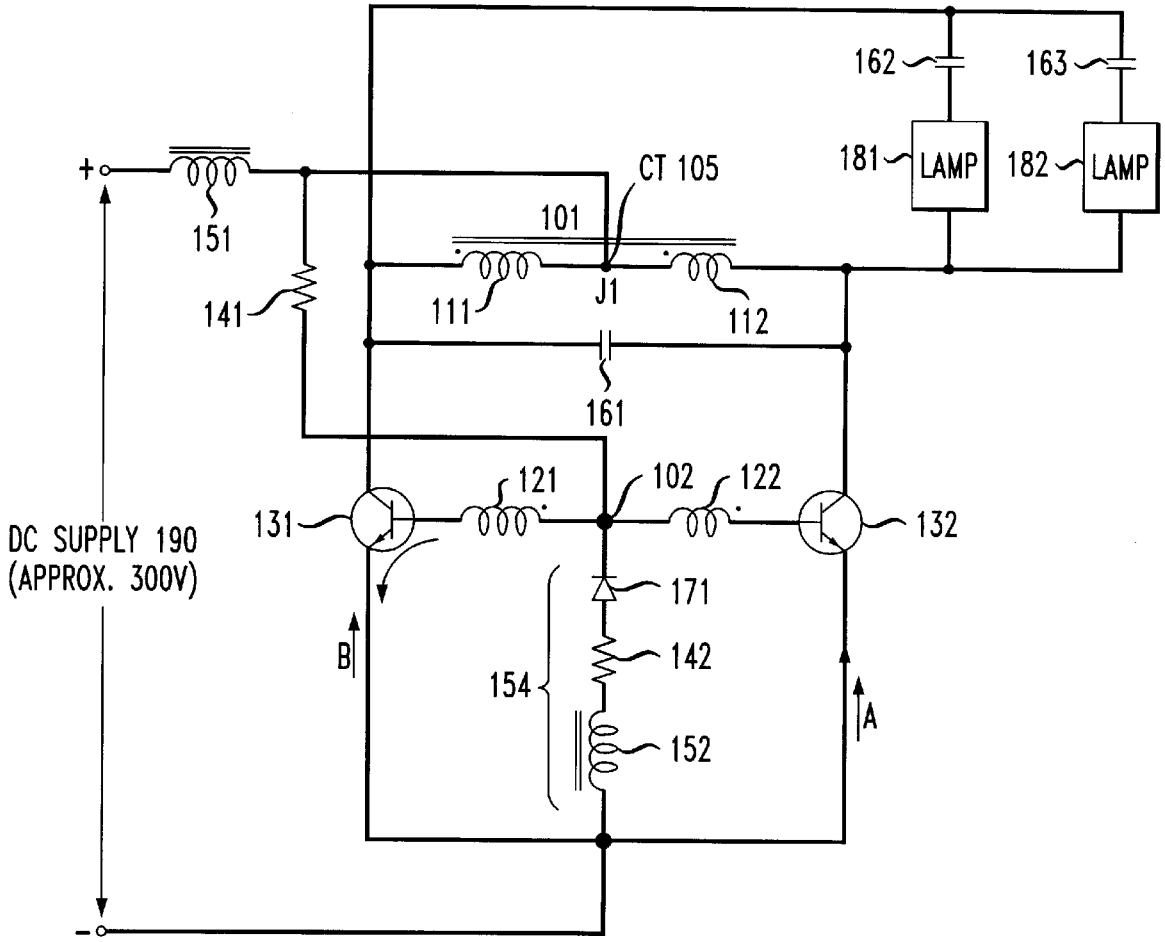
FIG. 1 PRIOR ART
FIG. 1 is a schematic diagram of a prior art parallel resonant, current-fed ballast circuit.

Transformer 101 is also coupled to the collector terminals of transistors 131 and 132. Linear inductor 151 is connected via resistor 141 to drive terminal 102, which is coupled to and disposed between the base terminals of transistors 131 and 132, respectively. In between drive terminal 102 and the base terminal of transistor 131 is drive winding 121. In between drive terminal 102 and the base terminal of transistor 132 is either a direct connection, or a parallel combination, comprised of capacitor 164 and resistor 143. In another embodiment of the present invention, the parallel combination is replaced by an additional drive winding coupled between drive terminal 102 and the base terminal of transistor 132 as illustrated in the corresponding portion of FIG. 1. The emitter terminals of transistor 131 and 132 are coupled to node 103 via diodes 174 and 175, respectively.

In the embodiment shown, the constant current flow network comprises linear inductor 152, resistor 142 and diodes 172 and 173. Diodes 172 and 173 are coupled to the base terminals of transistors 131 and 132, respectively. Transformer 101 is coupled to capacitors 162 and 163, which are in turn coupled to lamps 181 and 182, respectively. In this embodiment, the lamps are coupled in parallel with each other and the capacitors are each coupled in series to each lamp. As will be understood, the present invention contemplates the use of a varying number of lamps in various configurations, such as series or parallel arrangements.

Linear inductor 151, connected to drive terminal 102 through resistor 141, provides a start-up current signal feed. The current signal feed is sufficient to supply the minimum base drive current signal level required by transistors 131 and 132 to start the transistors into an oscillating mode, though other means to begin the oscillation are contemplated by the present invention.

As described previously, in the oscillating mode, transistors 131 and 132 are continuously turned "on" and "off", so as to conduct current alternately through each of primary windings 111 and 112. The alternating voltage level across the primary windings creates an AC current flow in the output to the lamps as follows. The impedance of capacitors 162 and 163 is greater than the impedance of lamps 181 and 182, and therefore dominates the control of the current flow through the lamps. Hence the current is subject, among other things, to the impedance of capacitors 162 and 163, the applied voltage and frequency.

When a current signal, flowing via inductor 151, and resistor 141 arrives at drive terminal 102, the tolerance in the voltage levels at transistors 131 and 132 determine which transistor will turn on first. Specifically, the transistor with the slightly lower base emitter voltage will be turned on first. As a result, a current signal is generated in winding 121 and arrives at drive terminal 102 where it is diverted, depending on its polarity, to, for example, the base terminal of transistor 131, so as to turn "on" transistor 131 and conduct collector-emitter current $I_{CE}$. As transistor 131 starts to turn on, there is an increasing positive voltage at the base terminal of transistor 131, which assists with turning on transistor 131 and is illustrative of the circuit's regenerative feedback feature. As a result, the voltage level at the collector terminal of transistor 131 goes to a saturated low state. The base drive current flows through the base-emitter junction of transistor 131 until it reaches node 103.

At node 103, the base drive current flows upwards into constant current flow network 154. This current cannot flow to the emitter of transistor 132 because diode 175 is configured to block any current flow in that direction. It is understood that diodes are merely one type of current blocking device suitable for blocking current flow to the emitter terminals of the transistors. The present invention contemplates the use of any type of device which blocks current from flowing into the emitter terminals of the transistors in the direction shown, such as a transistor, in its "off" state.

The existence of diodes 174 and 175 enables the use of drive voltages, on winding 121, for driving transistors 131 and 132, in excess of the transistor's typical base emitter breakdown voltage, which is in the range of 6.5 to 7 volts. Rather than these smaller drive voltages, diodes 174 and 175 permit the use of higher drive voltages in excess of 10 volts and in the vicinity of 20 to 30 volts. The use of higher drive voltages is highly desirable, as it, among other things, results in rapid, efficient switching of the transistors, thus avoiding the excessive switching losses suffered by the prior art circuits, and greatly extends the working voltage range for dimming applications.

As shown in FIG. 2, diodes 172 and 173 provide a "steering" action of the drive current signal which flows through constant current flow network 154. As previously discussed, the anode terminal of diodes 172 and 173 are coupled together, and in series with resistor 142 and linear inductor 152, though other configurations are contemplated. Particularly, the present invention contemplates the constant current feed network configuration shown in the prior art circuit illustrated in FIG. 1, in which diodes 172 and 173 are replaced by a single diode, coupled on one end to resistor 142 and linear inductor 152, and coupled on the other end to drive terminal 102.

Each diode 172 and 173, in the embodiment illustrated, is configured so as to cause current to flow to the base terminals of transistors 131 and 132, respectively, depending on polarity of winding 121. Additionally, diode 172 is configured so as to prevent the flow of current in a direction from the base terminal of transistor 131 to constant current flow network 154. Similarly, diode 173 is configured so as to prevent the flow of current in a direction from the base terminal of transistor 132 to constant current flow network 154. Therefore, the current signal flows through either diode 172 or 173 based upon the polarity of winding 121 and the voltage levels at the base terminals of the transistors.

Constant current flow network 154, in FIG. 2, operates to maintain a biasing current flow to the base terminals of transistors 131 and 132. As explained previously, the biasing current signal to drive each transistor is supplied by the constant current flow network to overcome the problem caused when the oscillating drive signal voltages provided by winding 121 to the base terminals of the transistors cross the zero voltage level. The zero voltage level occurs when one transistor is turning on and the other transistor is simultaneously turning off.

For instance, when transistor 131 is turning on, current starts to flow into the base to the emitter terminal. However, very little of that current comes from the base of transistor 132, because transistor 132 is, reversed biased, at the same time transistor 131 is turning "on" and the voltage on the base terminal of transistor 132 is going negative. With a negative voltage on its base, transistor 132 acts like a diode and will not conduct current from its emitter terminal to its base terminal. During this period diode 173 will conduct so as to supply current from the constant current drive network 154 to the base terminal of transistor 131 via winding 121. It is noted that the current from linear inductor 151 is insufficient to drive the transistors, since resistor 141 conducts a small current sufficient to initially start-up the circuit into the oscillating mode during the turn "on." Thus, current must flow from the constant current flow network in order for the circuit to operate properly during the change-over period. The current signal from the constant current flow network is diverted through either diode 172 or 173, as a voltage polarity starts to develop across winding 121.

Returning to the previous example, for the first half cycle, when transistor 131 is conducting current, at a later period in the cycle, the voltage level on the collector terminal of transistor 131 and on the start of the windings (shown by the dot 133) will be low. By contrast, the voltage level on the collector terminal of transistor 132, which is turned off and has no current flowing through it, is high. Hence there is a voltage impressed across the primary winding and across winding 121. As a result, the current which flows through resistor 142 of the constant current flow network, is diverted by the voltage across winding 121 through diode 173 via winding 121 towards the base of transistor 131. At the end of this cycle the voltage on winding 121 falls to zero but diode 173 continues to conduct the constant current signal which now arrives at the base terminal of transistor 132, causing it to turn "on" and to conduct current. Once again, this turn "on" action is enhanced by regenerative feedback from winding 121 causing a positive biasing voltage level which develops at the base of transistor 132 taking the base of transistor 132 positive and the base of transistor 131 negative, such that the drive current is diverted from diode 173 to diode 172 via winding 121, when transistor 132 is just turning on. This turn "on" action is further enhanced by the inclusion of the parallel combination of capacitor 164 and resistor 143, as will be explained later.

For the second half cycle, transistor 132 conducts a base-emitter current signal which is blocked from flowing to the emitter terminal of transistor 131 by diode 174. The current instead flows through constant current flow network 154, to be diverted through diode 172 as a result of the voltage developed across winding 121 as applied at the bases of the transistors. Since transistor 132 is conducting current, its collector terminal voltage is now low, while transistor 131, (which was turned off when transistor 132 was turned on) has a higher collector terminal voltage. At the end of this second half cycle, the voltage across winding 121 will drop to zero at which time the drive current signal will continue to flow through diode 172 and then via diode 173 and winding 121 to turn on transistor 131 again. This switching action is repeated in alternating fashion, first transistor 131 conducting current in one direction through the primary windings while transistor 132 is turned off, and then transistor 132 conducting current in the opposite direction through the primary windings while transistor 131 is turned off. By establishing the oscillation mode of the two transistors, an AC current is developed via capacitors 162 and 163 to operate fluorescent lamps 181 and 182.

As previously mentioned, this switching back and forth between transistor 131 and transistor 132 is enhanced by the existence of the parallel combination of resistor 143 and capacitor 164. Specifically, the advantage of the parallel combination can be shown by considering the point in time when transistor 131 is just turning "off" and transistor 132 is just turning "on". As the voltage on drive winding 121 begins to reverse, i.e.—as the sine wave passes through zero, current will flow out of the base terminal of transistor 131, through winding 121, through the low impedance of capacitor 164 and into the base terminal of transistor 132. The initial effect on transistor 131 will be to cause its base-emitter junction, along with diode 174, to block current flow. However, current continues to flow from the base-collector junction of transistor 131 through winding 121, capacitor 164 and into the base terminal of transistor 132. This current flow from the base-collector junction of 131 is approximately equal to the previous collector current in transistor 131, and as such, provides a large current pulse which, in this half cycle, enhances the rapid turn off of transistor 131 and the rapid turn on of transistor 132. The higher drive voltage levels permitted by the present invention, causes this turn "off" and turn "on" current pulse to be significantly faster than previously possible with prior art circuits.

After the initial pulse, a smaller current is needed to maintain the transistor "on". This smaller current flows through resistor 143, and is supplied by linear inductor 152 of constant current flow network 154. In the above example, where transistor 132 is conducting current, the base drive current flows through the base emitter of transistor 132, diode 175, inductor 152 and resistor 142 of the constant current flow network, diode 172, winding 121 and resistor 143, while at the same time, the main current flows from induction 151 via winding 101, transistor 132, diode 175 to return to the negative terminal of the D.C. supply.

The arrangement of blocking diodes 174 and 175, in accordance with one embodiment of the invention, allows for a substantially larger resistance value for resistor 142 than possible without the blocking diodes. While the circuit shown in FIG. 1 must maintain relatively small drive voltages and hence a resistor 142 with a relatively small resistive value, the circuit of the present invention can utilize a resistor 142 with a much larger resistive value. For example, rather than a resistive value of 10 to 20 ohms, the present invention can utilize a resistive value of approximately 1 to 2 Kohms, which reduces the change in the drive current as the supply voltage changes.

Thus, the circuit, in accordance with one embodiment of the present invention, can utilize a DC supply voltage over a much greater range than the circuits of the prior art. For example, a range of approximately 150–400 volts is possible, without causing the lamps to function improperly. The ability to use a wide range of supply voltages makes the circuit of the present invention ideally suited for dimming applications. Over a range of supply voltages from 150–400 volts, the lamps of the present invention can be efficiently dimmed over a range of approximately 10 or 20 to 1.

As discussed previously, diodes 174 and 175 block the reverse flow of current into the emitter of the transistors. When a negative voltage is applied to the base-emitter junction of the transistor, however, a reverse recovery current does flow through the blocking diodes, for a short amount of time referred to as the reverse recovery time. In order to optimize the efficiency of the transistor switching, the characteristics of the diodes are advantageously matched with those of the transistors. Specifically, in accordance with one embodiment of the present invention, the reverse recovery time of the diodes is chosen to be substantially the same as the reverse turn-off time for its associated transistor. As a result, the transistors will turn off at the same time that the diode begins blocking the reverse current flow into the emitter terminal of the transistor. It is noted that, in accordance with one embodiment of the invention, diodes with reverse recovery times less than the reverse turn-off times of the transistors can also be chosen.

Figure 3:
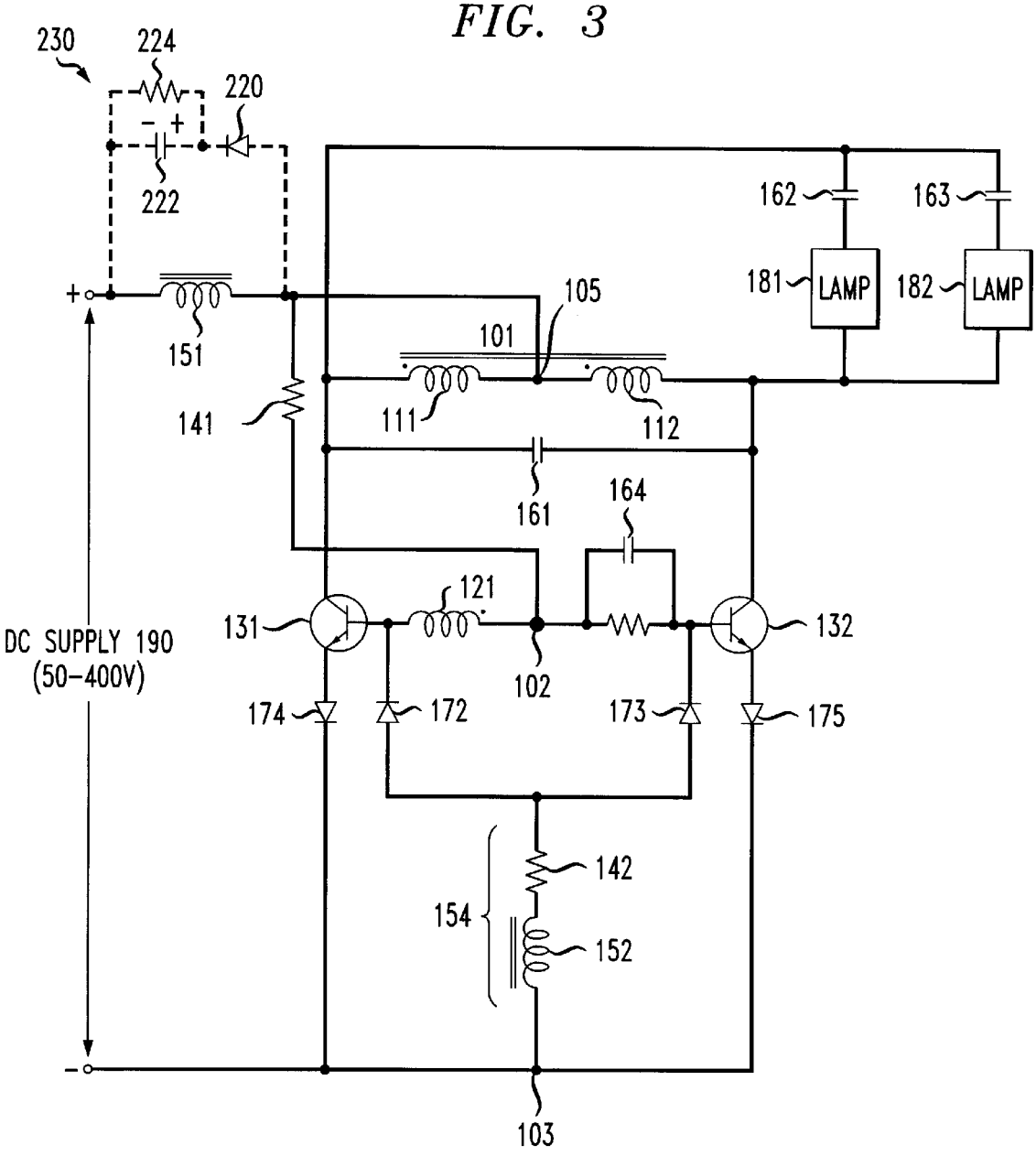
FIG. 3 is schematic diagram of a parallel resonant circuit in accordance with another embodiment of the invention.

FIG. 3 illustrates the parallel resonant ballast circuit of FIG. 2, which employs an over voltage snubber circuit 230 in accordance with another embodiment of the invention. Snubber circuit 230 includes a clamp diode coupled in series to a combination of a capacitor coupled in parallel with a resistor. As illustrated, the first terminal of inductor 151 is coupled to the anode terminal of a clamp diode 220. The cathode terminal of diode 220 is coupled to one terminal of capacitor 222. The other terminal of capacitor 222 is coupled to the second terminal of inductor 151. A resistor 224 is also coupled across capacitor 224.

Snubber circuit 230 provides protection to transistors 131 and 132, when a lamp is replaced or removed, or when a lamp fails an open circuit condition while the ballast is operating. For example, when a lamp's terminals are removed from a socket during a working condition an arc is caused. The arc power is added to the lamp power, resulting in an increase of current in inductor 151 with a potential for damage to transistors 131 and 132. Furthermore, replacing a lamp during the working condition may also result in potential damage to transistors 131 and 132. In both circumstances the arc results in an increase in current in inductor 151 and causes the inductor to accumulate energy equivalent to $\frac{1}{2} L*I^2$, where L is the inductance of inductor 151. Without the snubber circuit this energy is transferred to capacitors 161,162 and 163 as $\frac{1}{2} C*V^2$, where C is the capacitance of the sum of the capacitors and V is the voltage accumulated across the capacitors. Since this capacitance is small as the energy in inductor 151 increases, the voltage level across the capacitors and consequently across transistors 131 and 132, increases instantly which may result in voltage breakdown in the transistors.

Snubber circuit 230 provides an alternative path for the excess current that flows through inductor 151. Thus, the accumulating energy across inductor 151 mainly transfers to capacitor 222 via diode 220. In order to direct the flow of energy, the capacitance of capacitor 222 has advantageously a substantially larger value than the capacitance of capacitors 161, 162 and 163. This in return reduces the voltage increases across capacitors 162, 163 and 161, and the voltage stress on the transistor.

During arcing, however, some progressive accumulation of energy occurs across capacitor 222 itself. This accumulation is discharged by resistor 224. The value of resistance 224 is such that there remains both adequate voltage protection and acceptable energy dissipation.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A ballast circuit for operating at least one gas discharge lamp, said circuit comprising:

first and second transistors, each having base, collector and emitter terminals;

first and second current-blocking devices, each coupled to an emitter terminal of said transistors and configured so as to block a current from flowing in a direction causing reverse biasing of a base-emitter junction of said transistors.

2. The circuit of claim 1, wherein said first and second current-blocking devices are diodes.

3. The circuit of claim 1, wherein said first and second current-blocking devices are transistors.

4. The circuit of claim 1, wherein said first and second current-blocking devices each have a reverse recovery time corresponding to a reverse blocking time of said first and second transistors.

5. The circuit of claim 1, wherein said circuit further comprises a transformer including a first and a second primary windings.

6. The circuit of claim 5, wherein said circuit further comprises a first capacitance means, coupled across said first primary winding to define therewith a resonant circuit.

7. The circuit of claim 6, wherein said circuit further comprises a current source coupled to a center tap terminal of said first primary winding.

8. The circuit of claim 1, wherein said circuit further comprises a constant current flow network coupled to said transistors so as to maintain said circuit in an oscillating mode.

9. In a current fed, parallel resonant ballast, a driving circuit comprising:

first and second transistors, each having base, collector and emitter terminals;

first and second current-blocking devices, each coupled to an emitter terminal of said transistors and configured so as to block a current from flowing in a direction causing reverse biasing of a base-emitter junction of said transistors.

10. The circuit of claim 9, wherein said first and second current-blocking devices are diodes.

11. The circuit of claim 9, wherein said first and second current-blocking devices are transistors.

12. The circuit of claim 9, wherein said first and second current-blocking devices each have a reverse recovery time corresponding to a reverse blocking time of said first and second transistors.

13. The circuit of claim 9, wherein said circuit further comprises a transformer including a first and a second primary windings.

14. The circuit of claim 13, wherein said circuit further comprises a first capacitance means, coupled across said first primary winding to define therewith a resonant circuit.

15. The circuit of claim 14, wherein said circuit further comprises a current source coupled to a center tap terminal of said first primary winding.

16. The circuit of claim 9, wherein said circuit further comprises a constant current flow network coupled to said transistors so as to maintain said circuit in an oscillating mode.

* * * * *